US010989156B2

(12) United States Patent
Fukuyoshi

(10) Patent No.: US 10,989,156 B2
(45) Date of Patent: Apr. 27, 2021

(54) ENGINE

(71) Applicant: Yanmar Co. Ltd., Osaka (JP)

(72) Inventor: Shinya Fukuyoshi, Osaka (JP)

(73) Assignee: Yanmar Power Technology Co., Ltd., Osaka (JP)

( * ) Notice: Subject to any disclaimer, the term of this patent is extended or adjusted under 35 U.S.C. 154(b) by 0 days.

(21) Appl. No.: 16/652,964

(22) PCT Filed: Sep. 3, 2018

(86) PCT No.: PCT/JP2018/032680
§ 371 (c)(1),
(2) Date: Apr. 1, 2020

(87) PCT Pub. No.: WO2019/082515
PCT Pub. Date: May 2, 2019

(65) Prior Publication Data

US 2020/0263647 A1 Aug. 20, 2020

(30) Foreign Application Priority Data

Oct. 26, 2017 (JP) ..... JP2017-207217

(51) Int. Cl.

| | |
|---|---|
| ***F02M 61/14*** | (2006.01) |
| ***F02M 61/16*** | (2006.01) |
| *F02B 75/12* | (2006.01) |
| *F02F 1/24* | (2006.01) |

(52) U.S. Cl.
CPC ..... *F02M 61/14* (2013.01); *F02M 61/168* (2013.01); *F02B 2075/125* (2013.01); *F02F 1/242* (2013.01); *F02M 2200/856* (2013.01); *F02M 2200/858* (2013.01)

(58) Field of Classification Search
CPC ..... F02M 61/14; F02M 61/168; F02M 2200/856; F02M 2200/858; F02M 61/16; F02B 2075/125; F02F 1/242; F02F 1/24
See application file for complete search history.

(56) References Cited

U.S. PATENT DOCUMENTS

| | | | | |
|---|---|---|---|---|
| 4,938,193 | A * | 7/1990 | Raufeisen | B25B 27/023 123/467 |
| 5,566,658 | A * | 10/1996 | Edwards | F02F 1/4214 123/470 |
| 5,934,254 | A * | 8/1999 | Vetters | F02M 61/14 123/470 |
| 6,769,409 | B2 * | 8/2004 | Evancik | F02M 61/14 123/463 |
| 6,863,053 | B2 * | 3/2005 | Suzuki | F02M 55/025 123/456 |

(Continued)

*Primary Examiner* — Xiao En Mo
(74) *Attorney, Agent, or Firm* — Chris Mizumoto

(57) ABSTRACT

An engine (1) includes a cylinder head (3), a retainer (80), a pressing member (70), and an injector (40). The cylinder head (3) has an attachment hole (15) formed therein. The retainer (80) is attached to the cylinder head (3). The pressing member (70) has a pressed surface (77) configured to be pressed by the retainer (80). The injector (40) is inserted into the attachment hole (15) and has an indentation (46) configured to be pressed by the pressing member (70). The indentation (46) is arranged inside the attachment hole (15). The pressed surface (77) is arranged outside the attachment hole (15).

1 Claim, 5 Drawing Sheets

(56) References Cited

U.S. PATENT DOCUMENTS

| | | | | |
|---|---|---|---|---|
| 2011/0061217 | A1* | 3/2011 | Shevela | B25B 27/0035 29/235 |
| 2013/0042473 | A1* | 2/2013 | Imam | B25B 27/0035 29/888.011 |
| 2015/0101190 | A1* | 4/2015 | Neal | B23P 6/04 29/888.011 |

* cited by examiner

ENGINE

CROSS-REFERENCE

This application is a national phase of an international application, PCT/JP2018/032680 filed on Sep. 3, 2018, which claims the benefit of Japanese Application No. 2017-207217 filed on Oct. 26, 2017.

TECHNICAL FIELD

The present invention relates to an engine having an injector configured to inject a fuel.

BACKGROUND ART

Traditionally, there is a technology to fix an injector by pressing the injector with a retainer and the like, in a diesel engine. Examples of such a type of engine are disclosed in Patent Literatures 1 and 2 (hereinafter, PTL 1 and PTL 2, respectively), for example.

As a typical attachment structure of the injector, PTL 1 discloses the following structure. Namely, an injector inserted into a cylinder head is pressed from the above by one end side of a retainer. The other end side of the retainer abuts the cylinder head and the like to serve as a fulcrum. A portion between the fulcrum and the injector is fastened and fixed by using a bolt.

PTL 2 discloses a structure in which a fuel injection valve is accommodated in a receiving bore of a cylinder head, and a clamping shoe is used to press the fuel injection valve to the cylinder head. An intermediate element is arranged between a valve housing of the fuel injection valve and the clamping shoe.

CITATION LIST

Patent Literature

PTL 1: Japanese Patent Application Laid-Open No. 2008-14231

PTL 2: Published Japanese translation of PCT application No. 2008-533374

SUMMARY OF INVENTION

Technical Problem

To achieve an object such as reduction of manufacturing costs, injectors having an identical structure are used in engines of a plurality of specifications, the engines having cylinder heads of different thicknesses, respectively. Under such a circumstance, the length of the injector may not be sufficient in relation to the thickness of the cylinder head. When the injector is short, a surface of the injector pressed down by the retainer or the clamping shoe (the surface may hereinafter be referred to as pressed surface) is positioned inside an attachment hole of the cylinder head. In this case, the structures of PTL 1 and PTL 2 cannot press the injector from the above.

If a large recessed portion is formed around the attachment hole on the top surface of the cylinder head to expose the pressed surface, and if a retainer or the like is arranged within the recessed portion, the injector can be pressed from the above, even if the injector is short. However, the formation of such a large recessed portion on the cylinder head may be difficult in terms of space and the like.

In view of the above, an object of the present invention is to provide an engine that allows attachment of an injector to the cylinder head with a simple structure even if the injector is short.

Solution to Problem and Advantages

Problems to be solved by the invention are as described above, and next, means for solving the problems and effects thereof will be described.

In an aspect of the invention, an engine having the following configuration is provided. Namely, the engine of the present embodiment includes a cylinder head, a retainer, a pressing member, and an injector. The cylinder head has an attachment hole formed therein. The retainer is attached to the cylinder head. The pressing member has a pressed surface configured to be pressed by the retainer. The injector is inserted into the attachment hole and has an indentation configured to be pressed by the pressing member. The indentation is arranged inside the attachment hole. The pressed surface is arranged outside the attachment hole. Between the sleeve and the pressing member, a gap relative to an insertion direction is formed, the insertion direction being a direction in which the injector is inserted into the attachment hole. The gap is smaller than a thickness of the seal member relative to the insertion direction.

Thus, even if the indentation of the injector is in the attachment hole of the cylinder head, the injector can be attached to the attaching hole by using the retainer to press the pressed surface of the pressing member, outside the attachment hole. Therefore, even if a relatively short injector is attached to the cylinder head, the injector can be fixed without a need for forming a recess in the cylinder head, around the attachment hole (or the injector can be fixed with a shallow recess). Therefore, injectors of the same length can be easily used for cylinder heads of different thicknesses. Further, if assembling of the seal member is forgotten, the injector wobbles with respect to the sleeve by an amount corresponding to the thickness. Since the gap between the sleeve and the pressing member is smaller than the thickness of the seal member while the seal member is present, wobbling of the injector cannot be solved without the seal member, even if the pressing member is pressed by the retainer to the extent the gap no longer exists. Therefore, whether or not the seal member is assembled can be easily confirmed based on whether or not the injector wobbles.

DESCRIPTION OF EMBODIMENTS

Figure 1:
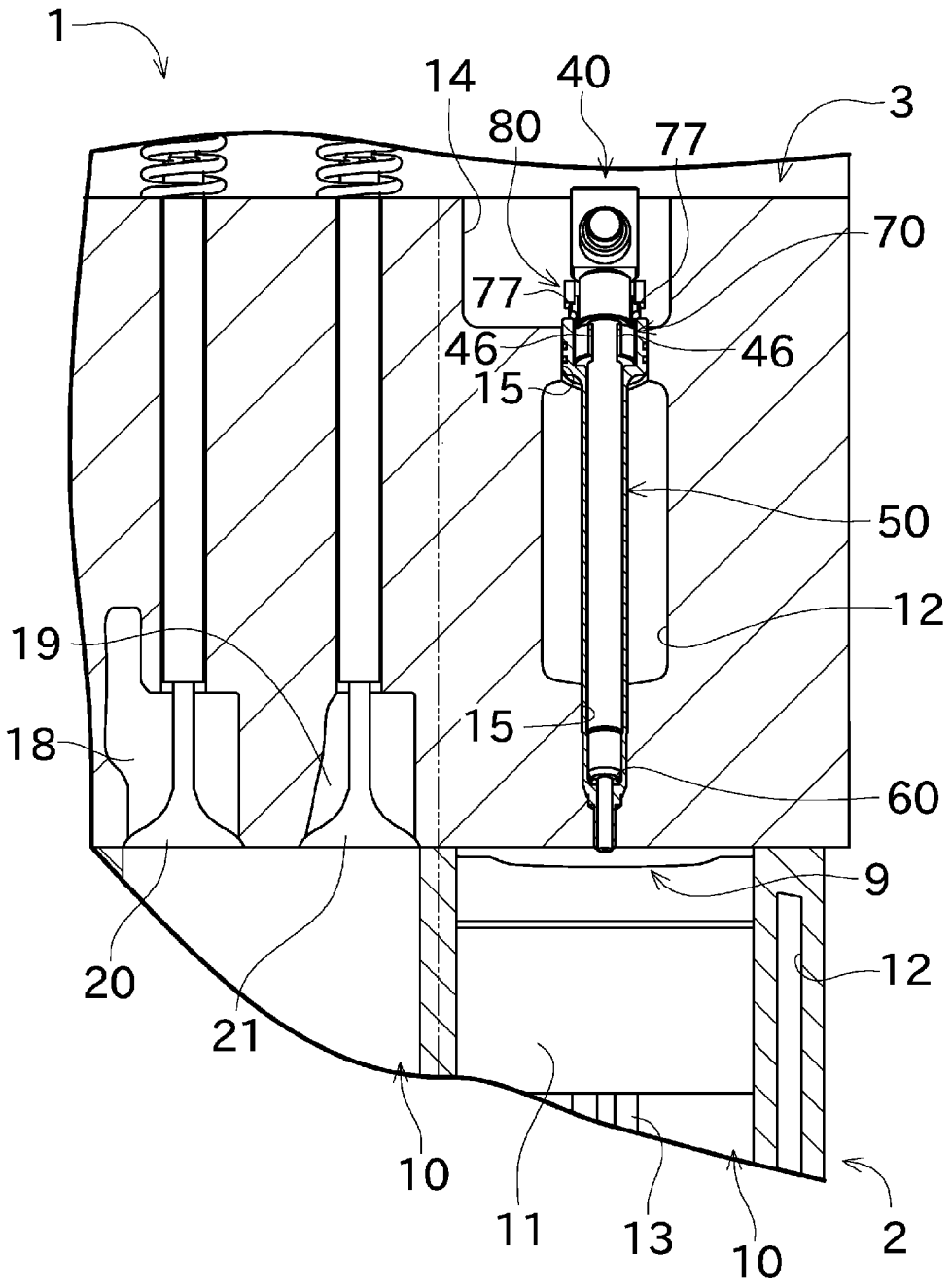
FIG. 1 A partial cross-sectional view of an engine related to one embodiment of the present invention.

Next, an embodiment of the present invention will be described with reference to the drawings. FIG. 1 is a partial cross-sectional view of an engine 1 related to one embodiment of the present invention.

The engine 1 shown in FIG. 1 is configured as a 4-cycle multiple-cylinder type dual-fuel engine and can be used as, for example, a main engine of a ship. The dual-fuel engine can be selectively driven in one of: a premix combustion mode in which fuel gas is mixed with the air and combusted; and a diffusion combustion mode in which a liquid fuel is diffused and combusted.

The engine 1 includes: a cylinder block 2, a cylinder head 3, an injector 40, a sleeve 50, packing (seal member) 60, a pressing member 70, and a retainer 80.

The cylinder block 2 has a plurality of cylinders 10. Each cylinder 10 accommodates a piston 11 capable of reciprocating in up-down directions. Inside the wall portion of the cylinder block 2, a water jacket 12 in which cooling water flows is formed around the cylinders 10.

Each cylinder 10 is formed so as to be open upward. The cylinder head 3 is fixed to the cylinder block 2 with a not-shown gasket sandwiched therebetween, in such a manner as to close the open portion of the cylinder 10. The cylinder block 2 and the cylinder head 3 form combustion chambers 9, and each of these combustion chambers 9 is arranged above the piston 11 of the cylinder 10. To the cylinder head 3, an injector 40 for injecting a liquid fuel to the combustion chamber 9 is attached.

While the engine 1 operates in the diffusion combustion mode, the air supplied into the combustion chamber 9 is compressed as the piston 11 rises, which raises the temperature of the air. Injecting the air from the injector 40 into this air causes self-ignition of the fuel, thus generating an expansion energy that moves down the piston 11.

Below the cylinder block 2, a crank case that rotatably supports a not-shown crankshaft is arranged. The crankshaft is connected to the piston 11 through a connecting rod 13. This way, the reciprocation of the piston 11 can be converted to rotation.

A not-shown fuel injection pump is arranged at a suitable position in the crank case. The fuel injection pump can suck in the fuel from a fuel tank and supply the fuel to the fuel supply port of the injector 40.

On the upper surface of the cylinder head 3, a recess 14 opening upward is formed. In the bottom portion of the recess 14, an attachment hole 15 for attaching the injector 40 is formed. Further, the retainer 80 is arranged in the bottom portion of the recess 14.

The cylinder head 3 has therein an air-intake port 18 that introduces the external air into the combustion chamber 9 and an exhaust gas port 19 that discharges the air inside the combustion chamber 9. Further, the cylinder head 3 has an air-intake valve 20 configured to open or close the air-intake port 18 and an exhaust valve 21 configured to open or close the exhaust gas port 19.

The attachment hole 15 is formed so as to penetrate the cylinder head 3. To this attachment hole 15, the cylindrical sleeve 50 and the injector 40 are inserted and attached.

Similarly to the cylinder block 2, the cylinder head 3 also has therein a water jacket 12 in which cooling water flows. The attachment hole 15 is formed in such a manner as to penetrate the cylinder block 2 from its top surface to its under surface, while crossing the water jacket 12. In a portion where the attachment hole 15 crosses the water jacket 12, the injector 40 is arranged inside the sleeve 50. This way, direct contact of the cooling water to the injector 40 can be suppressed or reduced.

Figure 2:
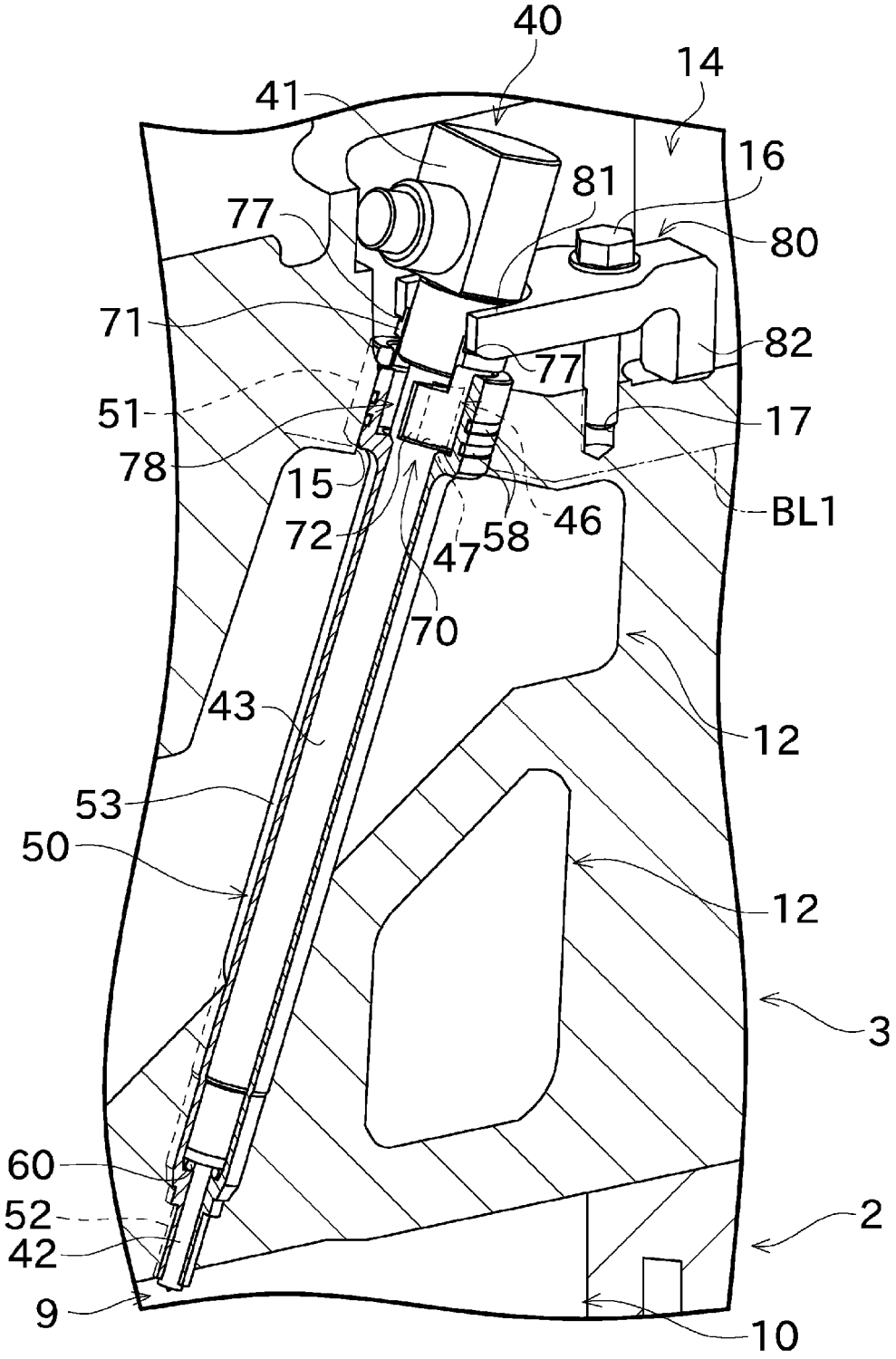
FIG. 2 A perspective cross-sectional view showing an attachment structure of an injector.
Figure 3:
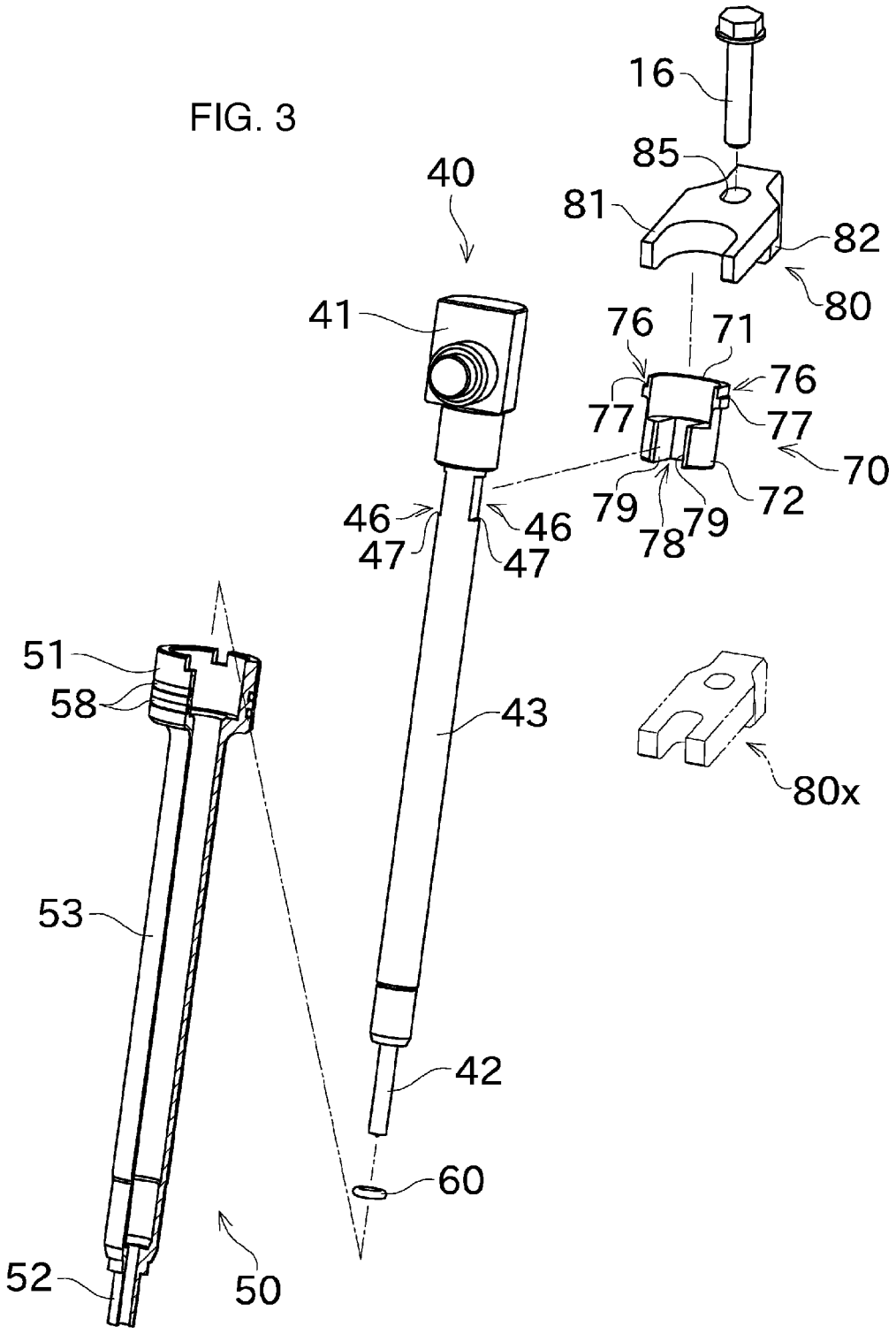
FIG. 3 An exploded perspective view showing the injector, a sleeve, a pressing member, and a retainer.
Figure 4:
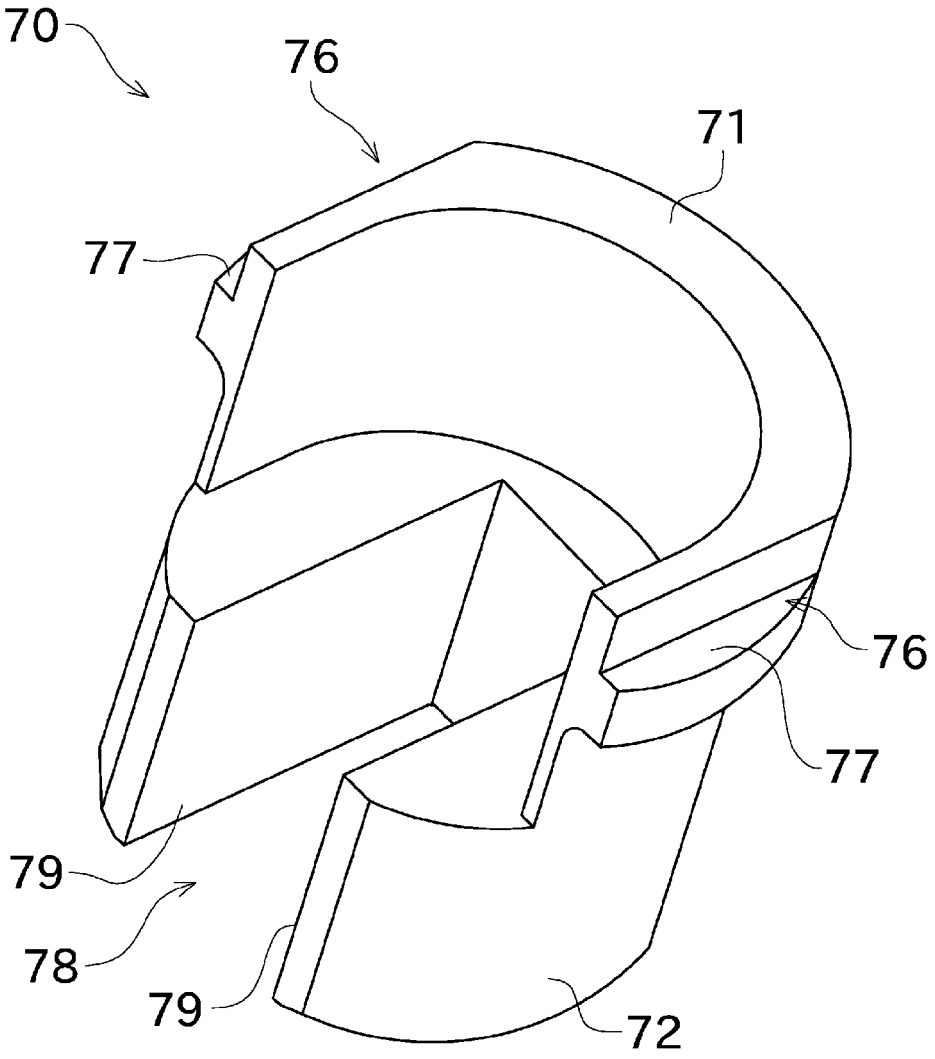
FIG. 4 A perspective view of the pressing member enlarged.

Next, the following details the attachment structure of the injector 40 with reference to FIG. 2 to FIG. 4. FIG. 2 is a perspective cross-sectional view showing an attachment structure of an injector 40. FIG. 3 is an exploded perspective view showing the injector 40, the sleeve 50, the pressing member 70, and the retainer 80. FIG. 4 is a perspective view of the pressing member 70 enlarged.

FIG. 2 shows a cross section of the cylinder head 3 taken in a direction different from FIG. 1. As shown in FIG. 2, the injector 40 includes a proximal end portion 41, a distal end portion 42, and an intermediate portion 43.

The proximal end portion 41 is arranged above the cylinder head 3 and has a not-shown fuel supply port formed in a suitable position. The distal end portion 42 is arranged close to the under surface of the cylinder head 3, and has a fuel injection port formed at its end surface. The intermediate portion 43 is formed so as to connect the proximal end portion 41 and the distal end portion 42.

As shown in FIG. 3, a pair of indentations 46 are formed at positions of the intermediate portion 43 of the injector 40, close to the proximal end portion 41. Each indentation 46 is formed by cutting out the outer circumferential surface of the injector 40 to form a plane shape perpendicular to a radial direction. The pair of indentations 46 are arranged so as to face each other across the center line of the injector 40. The portion of the intermediate portion 43 where the indentations 46 are formed has a slightly reduced width as compared to the width of the other portion.

At an end portion of each indentation 46 closer to the distal end portion 42, there is a step portion formed between the indentation 46 and the portion having no indentation. In this step portion, a small contact surface 47 that can contact the under surface of the later-described pressing member 70 is formed. This contact surface 47 is oriented to be perpendicular to the center line of the injector 40.

The sleeve 50 is formed generally in a cylindrical shape. The sleeve 50 is formed so as to connect an upper open end and a lower open end of the attachment hole 15 formed in the cylinder head 3. Most of the injector 40 is arranged in the axial bore of the sleeve 50.

The sleeve 50 includes a large diameter portion 51, a small diameter portion 52, and an intermediate portion 53.

The large diameter portion 51 is arranged in a position corresponding to the upper open end of the attachment hole 15. The large diameter portion 51 is formed in a cylindrical shape, and its outer diameter and its inner diameter are larger than those of the later-described intermediate portion 53. As shown in FIG. 2, the large diameter portion 51 is mostly inside the attachment hole 15.

Inside the large diameter portion 51, the intermediate portion 43 of the injector 40 (specifically, a part where the indentations 46 are formed) is inserted, and a part of the lower portion of the pressing member 70 (a later-described attaching part 72) is inserted. In the outer circumferential surface of the large diameter portion 51, an annular groove is formed. In this groove, an O-ring 58 for sealing between the sleeve 50 and the attachment hole 15 is arranged.

The small diameter portion 52 is arranged in a position corresponding to the lower open end of the attachment hole 15. The small diameter portion 52 is formed in a cylindrical shape, and its outer diameter and its inner diameter are smaller than those of the later-described intermediate portion 53.

Inside the small diameter portion 52, the distal end portion 42 of the injector 40 is inserted. The fuel injection port at the distal end portion 42 of the injector 40 is exposed to the combustion chamber 9 through an opening of the small diameter portion 52 (an open end of the axial bore of the sleeve 50).

The intermediate portion 53 is formed in a cylindrical shape, and connects the large diameter portion 51 and the small diameter portion 52. The inside of the intermediate portion 53 is in communication with the insides of the large diameter portion 51 and the small diameter portion 52. The inner diameter of the intermediate portion 53 is slightly larger than the outer diameter of the intermediate portion 43 of the injector 40. The outer circumferential surface of the intermediate portion 53 faces the water jacket 12 formed in the cylinder head 3.

There is an annular step portion on the inner wall of the axial bore, at a border portion between the intermediate portion 53 and the small diameter portion 52 of the sleeve 50. Corresponding to this border portion, the injector 40 has an annular step portion at a border portion between the intermediate portion 43 and the distal end portion 42 of the injector 40. Between the step portion of the axial bore of the sleeve 50 and the step portion of the injector 40, later-described packing 60 is arranged.

The packing 60 is formed in a small ring-like shape and closely contacts with both the sleeve 50 and the injector 40, thereby providing a seal between the sleeve 50 and the injector 40. This suppresses and reduces the fuel from entering the gap between the injector 40 and the sleeve 50, the fuel being injected from the fuel injection port.

As shown in FIG. 4 and the like, the pressing member 70 is structured to have a shape such that a cylindrical column is partially cut out. The injector 40 is attached inside the pressing member 70, as shown in FIG. 2. The pressing member 70 is arranged partially inside and partially outside the attachment hole 15 (in other words, arranged partially inside and partially outside the large diameter portions 51 of the sleeve 50).

As shown in FIG. 4 and the like, the pressing member 70 has a structure such that a receiving part 71 and an attaching part 72 are formed in one piece.

The receiving part 71 is formed in a substantially C-shape in a plan view. At an upper end of the receiving part 71, a pair of cutout parts 76 are formed. Each cutout part 76 is formed by cutting out the outer circumferential surface of the receiving part 71 to form a plane shape perpendicular to a radial direction. The pair of cutout parts 76 are arranged so as to face each other across the center line of the pressing member 70.

At an end portion of each cutout part 76 closer to the attaching part 72, there is a step portion formed between the cutout part 76 and a portion having no cutout part. In this step portion, a small pressed surface 77 that can contact the under surface of the retainer 80 is formed. This pressed surface 77 is oriented to be perpendicular to the center line of the pressing member 70. The distance between the pair of pressed surfaces 77 is greater than the distance between the above-described contact surfaces 47.

The attaching part 72 is formed substantially in a cylindrical shape, and disposed to be continuous with respect to the receiving part 71 in the axial direction. The diameter of the attaching part 72 is slightly smaller than the inner diameter of the large diameter portion 51 of the sleeve 50.

The attaching part 72 has an insertion recess 78 having a quadrangular shape in a plan view which is formed so as to penetrate the attaching part 72 in the axial direction. An open side of the insertion recess 78 matches with an open side of the receiving part 71 formed in a C-shape. With this, the injector 40 can be inserted into the pressing member 70.

To the insertion recess 78, the portion of the intermediate portion 43 of the injector 40 having the indentations 46, is inserted. A pair of inner walls 79 of the insertion recess 78 facing each other are arranged to face each other across the center line of the pressing member 70. The directions in which the inner walls face each other correspond to the directions in which the indentations 76 face each other. The pair of inner walls 79 face or contact the indentations 46 while the injector 40 is attached to the attaching part 72.

When the injector 40 is attached to the attachment hole 15, the above-described attaching part 72 is inserted into the large diameter portion 51 of the sleeve 50, as shown in FIG. 2. Therefore, the indentations 46 (contact surfaces 47) of the injector 40 to which the attaching portion 72 is attached are each positioned inside the large diameter portion 51, i.e., inside the attachment hole 15. On the other hand, the receiving part 71 of the pressing member 70 protrudes upward from the upper end of the sleeve 50, without being inserted into the inside of the large diameter portion 51. As a result, the pressed surfaces 77 of the receiving unit 71 are positioned outside the large diameter portion 51, i.e., outside the attachment hole 15.

The retainer 80 can be fixed above the cylinder head 3, while pressing down the injector 40 via the pressing member 70.

The structure of the retainer 80 is substantially the same as one disclosed in PTL 1, and therefore is described briefly in the following description. The retainer 80 is formed in a substantially L-shape and is arranged over the upper end of the pressing member 70 and the cylinder head 3.

One end of the retainer 80 has a pressing part 81 formed in a bifurcated shape. The under surface of the bifurcated pressing part 81 contacts the pressed surfaces 77 formed on the pressing member 70. At an end portion of the retainer 80 opposite to the pressing part 81, a perpendicularly bent fulcrum part 82 is formed. A lower end of the fulcrum part 82 can contact the upper surface of the cylinder head 3 (an inner bottom surface of the recess 14). The retainer 80 has a bolt hole 85 as shown in FIG. 3 perforated at a midway position between the pressing part 81 and the fulcrum part 82. To the bolt hole 85, a bolt 16 is inserted and this bolt 16 is screwed into a screw hole 17 formed in the upper surface of the cylinder head 3 as shown in FIG. 2. In this structure, the bolt 16 is fastened while the bifurcated portion of the pressing part 81 presses the pressed surfaces 77 of the pressing member 70, thereby providing a force in a direction of pushing in the pressing member 70 into the attachment hole 15. Thus, the pressing member 70 and the injector 40 can be fixed.

In the example shown in FIG. 1 and FIG. 2, the injector 40 is relatively short with respect to the thickness of the cylinder head 3 and the indentations 46 are in the attachment hole 15, even with the recess 14 for reducing the depth of the attachment hole 15 on the upper surface of the cylinder head 3. In a case where the cylinder head 3 is thin and the indentations 46 are exposed to the outside from the attachment hole, the indentations 46 (contact surfaces 47) can be directly pressed and fixed by using a retainer 80*x* shown in a chain line in FIG. 3. The structure of this retainer 80*x* is substantially the same as that of the above-described retainer 80 for pressing the pressing member 70, except in that the distance between the bifurcated portions are reduced so as to enable pressing of the pair of indentations 46. The pressing member 70 is not necessary in cases of fixing the injector 40 with the retainer 80*x*.

As should be understood, with the present invention, the injector 40 can be fixed by a plurality of methods, depending on the thickness of the cylinder head 3. Therefore, variation in the method of fixing can be achieved.

It should be noted that, even in the example of FIG. 2 in which the cylinder head 3 is thick, the indentations 46 are exposed to the outside the attachment hole 15 if the recess 14 formed on the upper surface is sufficiently deepened, for example, down to the level shown by an imaginary line BL1. By doing so, the injector 40 can be directly fixed by the retainer 80*x*. However, deepening the recess 14 causes difficulty in laying out the water jacket 12 arranged inside the cylinder head 3, which may lead to a drop in the cooling performance. In this regard, the present embodiment is advantageous in that, with use of the pressing member 70, the injector 40 can be reliably fixed to the cylinder head 3 even if the injector 40 is short, simply by forming a recess 14 which is not so deep on the cylinder head 3.

Figure 5:
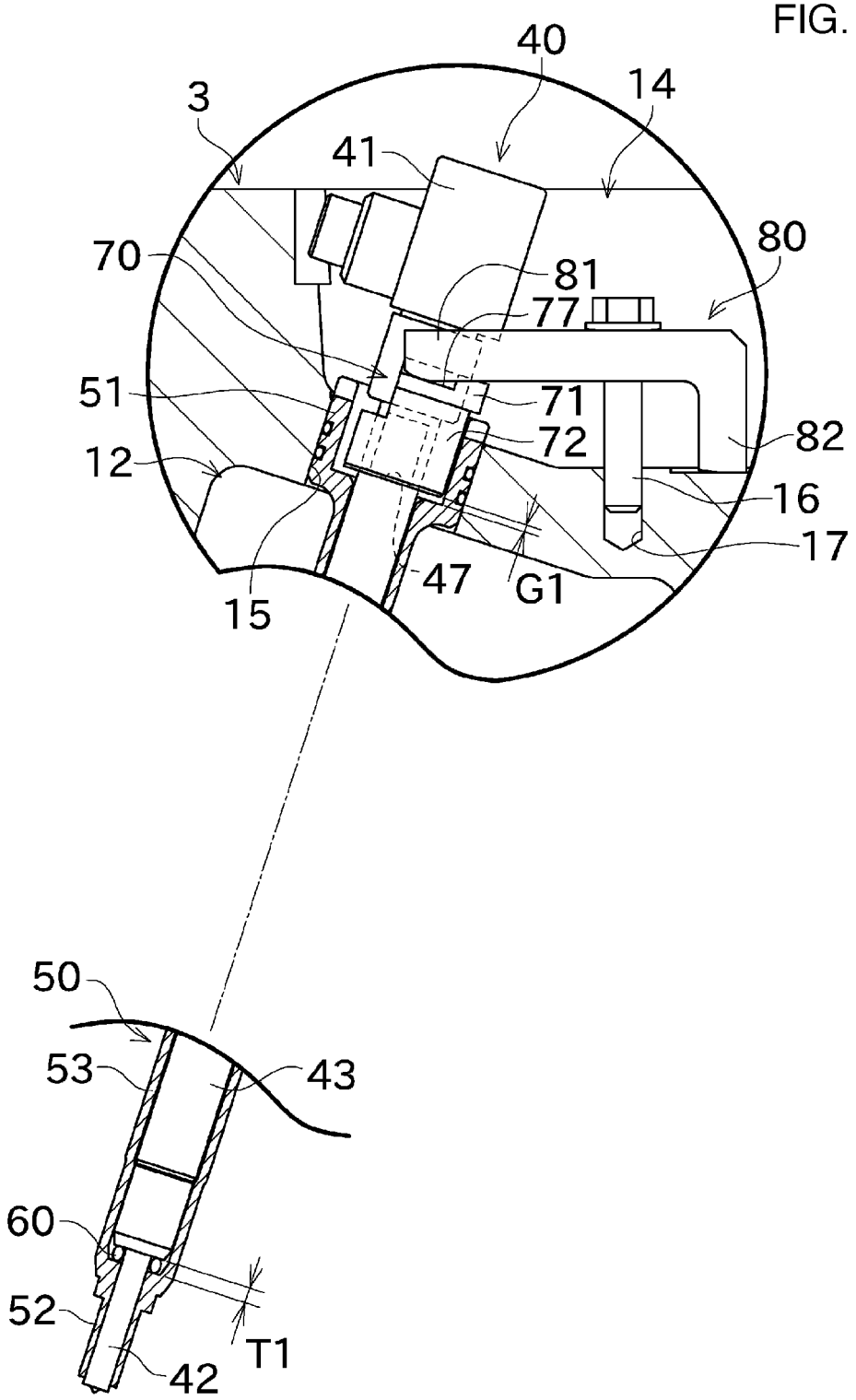
FIG. 5 A cross-sectional view showing a gap formed between an under surface of the pressing member and the sleeve.

Next, with reference to FIG. 5, the following describes a gap formed between the under surface of the pressing member 70 and an inner bottom surface of the large diameter portion 51 of the sleeve 50. FIG. 5 is a cross-sectional view showing a gap formed between an under surface of the pressing member 70 and the sleeve 50.

As shown in FIG. 5, a gap G1 relative to a direction in which the injector 40 is inserted into the attachment hole 15 (hereinafter, insertion direction) is formed between the under surface of the attaching part 72 inserted into the large diameter portion 51 of the sleeve 50 and the inner bottom surface of the large diameter portion 51, while the injector 40 is attached to the cylinder head 3 by using the pressing member 70. This gap G1 is smaller than the thickness T1 of the packing 60 relative to the insertion direction (G1<T1), the packing 60 arranged on the distal end side of the injector 40.

When the pressing member 70 is attached to the injector 40, without the packing 60 arranged on the distal end side of the injector 40, the pressing member 70 pressed by the retainer 80 sinks in the insertion direction of the injector 40 so as to fill the gap G1, and the under surface of the attaching part 72 eventually contacts the inner bottom surface of the sleeve 50. However, because the gap G1 is smaller than the thickness T1 of the packing 60, there will be a play between the injector 40 and the sleeve 50 even after the gap G1 no longer exists. Therefore, if assembling of the packing 60 is forgotten, the injector 40 wobbles with respect to the sleeve 50. Therefore, missing of the packing 60 can be easily noticed. As a result, the presence or absence of the packing 60 in a position that cannot be visually confirmed from outside can be easily determined based on whether or not the injector 40 wobbles.

As hereinabove described, an engine 1 of the present embodiment includes a cylinder head 3, a retainer 80, a pressing member 70, and an injector 40. The cylinder head 3 has an attachment hole 15 formed therein. The retainer 80 is attached to the cylinder head 3. The pressing member 70 has a pressed surface 77 configured to be pressed by the retainer 80. The injector 40 is inserted into the attachment hole 15 and has an indentation 46 configured to be pressed by the pressing member 70. The indentation 46 is arranged inside the attachment hole 15. The pressed surface 77 is arranged outside the attachment hole 15.

Thus, even if the indentation 46 of the injector 40 is in the attachment hole 15 of the cylinder head 3, the injector 40 can be attached to the attaching hole 15 by using the retainer 80 to press the pressed surface 77 of the pressing member 70, outside the attachment hole 15. Therefore, even if a relatively short injector 40 is attached to the cylinder head 3, the injector 40 can be fixed without a need for forming a recess in the cylinder head 3, around the attachment hole 15 (or the injector 40 can be fixed with a shallow recess 14).

Further, the engine 1 of the present embodiment includes a cylindrical sleeve 50 and packing 60. The sleeve 50 is arranged outside the injector 40, and is inserted into the attachment hole 15. The packing 60 is arranged between a distal end portion of the injector 40 and the sleeve 50. Between the sleeve 50 and the pressing member 70, a gap G1 relative to an insertion direction is formed, the insertion direction being a direction in which the injector 40 is inserted into the attachment hole 15. The gap G1 is smaller than a thickness T1 of the packing 60 relative to the insertion direction (G1<T1).

If assembling of the packing 60 to be arranged to the distal end portion 42 of the injector 40 is forgotten, the injector 40 wobbles with respect to the sleeve 50 by an amount corresponding to the thickness T1. Since the gap G1 between the sleeve 50 and the pressing member 70 is smaller than the thickness T1 of the packing 60 while the packing 60 is present, wobbling of the injector 40 cannot be solved without the packing 60, even if the pressing member 70 is pressed by the retainer 80 to the extent the gap G1 no longer exists. Therefore, whether or not the packing 60 is assembled can be easily confirmed based on whether or not the injector 40 wobbles.

Although a preferred embodiment of the present invention has been described above, the above-described configuration can be modified, for example, as follows.

The retainer 80 may be any structure provided that it can press the pressed surface 77 of the pressing member 70. For example, the positions of the pressing part 81 and the bolt hole 85 can be the other way around, or the positions of the bolt hole 85 and the fulcrum part 82 can be the other way around. Further, for example, the retainer can be a T-shape or a plate-like shape, instead of an L-shape.

The retainer 80 can be a different member fixed to the cylinder head 3, instead of a member directly attached to the cylinder head 3 with the use of a bolt 16. Such a case can also be considered as the retainer 80 being attached to the cylinder head 3.

If the thickness of the cylinder head 3 is not large, the injector 40 can be fixed to the cylinder head 3 through the pressing member 70, without forming the recess 14.

The present invention can also be applied to a normal diesel engine, in addition to a dual-fuel engine.

REFERENCE SIGNS LIST 1 engine
3 cylinder head
15 attachment hole
40 injector
50 sleeve
70 pressing member
77 pressed surface
46 indentation
60 packing (seal member)
80 retainer
G1 gap
T1 thickness of packing

The invention claimed is:

1. An engine, comprising:

a cylinder head having an attachment hole formed therein;

a retainer attached to the cylinder head;

a pressing member having a pressed surface configured to be pressed by the retainer;

an injector inserted into the attachment hole and having an indentation configured to be pressed by the pressing member;

a cylindrical sleeve is arranged outside the injector and inserted into the attachment hole; and a seal member arranged between a distal end portion of the injector and the sleeve, wherein the indentation is arranged inside the attachment hole, the pressed surface is arranged outside the attachment hole, a gap relative to an insertion direction is formed between the sleeve and the pressing member, the insertion direction being a direction in which the injector is inserted into the attachment hole, and the gap is smaller than a thickness of the seal member relative to the insertion direction.

* * * * *